US007497541B2

(12) United States Patent
Usuda et al.

(10) Patent No.: US 7,497,541 B2
(45) Date of Patent: Mar. 3, 2009

(54) DROPLET DISCHARGING APPARATUS AND METHOD, FILM MANUFACTURING APPARATUS AND METHOD, DEVICE MANUFACTURING METHOD, AND ELECTRONIC EQUIPMENT

(75) Inventors: Hidenori Usuda, Matsumoto (JP); Yasushi Hashizume, Shujiri (JP); Yasuhiro Hiraide, Hata-machi (JP)

(73) Assignee: Seiko Epson Corporation (JP)

( * ) Notice: Subject to any disclaimer, the term of this patent is extended or adjusted under 35 U.S.C. 154(b) by 236 days.

(21) Appl. No.: 10/698,001

(22) Filed: Oct. 30, 2003

(65) Prior Publication Data

US 2004/0135831 A1 Jul. 15, 2004

(30) Foreign Application Priority Data

Nov. 1, 2002 (JP) ..... 2002-319773

(51) Int. Cl.
*B41J 29/38* (2006.01)
*B41J 2/45* (2006.01)
*B41J 2/165* (2006.01)

(52) U.S. Cl. ..... 347/17; 347/23; 347/70

(58) Field of Classification Search ..... 347/9, 347/10, 11, 14, 20
See application file for complete search history.

(56) References Cited

U.S. PATENT DOCUMENTS 4,633,269 A * 12/1986 Mikami et al. ..... 347/188
5,066,964 A * 11/1991 Fukuda et al. ..... 347/18
5,805,177 A * 9/1998 Takahashi ..... 347/11
5,861,895 A * 1/1999 Tajika et al. ..... 347/14
6,033,050 A * 3/2000 Morita et al. ..... 347/23
6,257,688 B1 * 7/2001 Kubo ..... 347/11
6,386,672 B1 * 5/2002 Kimura et al. ..... 347/18
6,454,377 B1 * 9/2002 Ishizaki ..... 347/15
6,499,821 B1 * 12/2002 Nozawa ..... 347/14
6,502,914 B2 * 1/2003 Hosono et al. ..... 347/11
6,530,636 B1 * 3/2003 Asauchi ..... 347/14
6,547,359 B2 * 4/2003 Fukano ..... 347/17
6,575,547 B2 * 6/2003 Sakuma ..... 347/18
6,695,437 B2 * 2/2004 Nakamura et al. ..... 347/70
6,714,173 B2 * 3/2004 Shinoura ..... 345/32
6,981,761 B2 * 1/2006 Usui et al. ..... 347/85
2004/0070651 A1 * 4/2004 Usui et al. ..... 347/84

FOREIGN PATENT DOCUMENTS

JP 03-272871 12/1991
JP 07-304168 11/1995

OTHER PUBLICATIONS

J.R. White, Newton's Law of Cooling, Aug. 1998□□<http://gershwin.ens.fr/vdaniel/Doc-Locale/Cours-Mirrored/Methodes-Maths/white/math/a1/nwtcool/nwtcool.html>.*

Avallone, A. Eugene, and Baumeister III, Theodore, "Marks' Standard Handbook for Mechanical Engineers," 10th Ed., McGraw-Hill, 1996; pp. 4-80.*

Communication from Korean Patent Office regarding related application.

* cited by examiner

*Primary Examiner*—Luu Matthew
*Assistant Examiner*—Shelby Fidler
(74) *Attorney, Agent, or Firm*—Harness, Dickey & Pierce, P.L.C.

(57) ABSTRACT

An apparatus discharges a discharge liquid in the form of droplets from apertures by mechanically deforming piezoelectric elements by a normal drive signal. The droplets are discharged from the apertures by a cooling drive signal, which is different from the normal drive signal.

33 Claims, 6 Drawing Sheets

NORMAL DRIVE SIGNAL

COOLING DRIVE SIGNAL

DROPLET DISCHARGING APPARATUS AND METHOD, FILM MANUFACTURING APPARATUS AND METHOD, DEVICE MANUFACTURING METHOD, AND ELECTRONIC EQUIPMENT

BACKGROUND OF THE INVENTION

1. Technical Field of the Invention

The present invention relates to a droplet discharging apparatus and method for discharging droplets toward a target object by using a piezoelectric element, a film manufacturing apparatus and method using the droplet discharging apparatus and method, a device manufacturing method, and electronic equipment.

2. Description of the Related Art

Japanese Unexamined Patent Application Publication No. 7-304168 discloses an ink injection apparatus as an example to which a droplet discharging apparatus has been applied. The ink injection apparatus is adapted to transmit the operating heat of a drive circuit (IC chip) to an inkjet head (recording head) to set the ink temperature at an appropriate level so as to stabilize discharging characteristics. In other words, according to the conventional technology, the heat generated by the operation of the drive circuit is transmitted to the inkjet head thereby to heat the ink, then the hot ink is discharged. Thus, the drive circuit is cooled without the need for providing a heat sink or the like.

However, in the droplet discharging apparatus using piezoelectric elements, the mechanical loss caused by the oscillation of the piezoelectric elements generates heat (operating heat). The operating heat heats a discharge liquid, such as ink, leading to reduced liquid viscosity, which causes the problem of failure in obtaining a specified ink weight, the occurrence of satellites or reduced ink droplet diameters or crooked ink flight. No effective solutions to such problems have been found so far. Maintaining a discharge liquid at a certain temperature is important for securing stable discharge (stable quality). Efforts have been made to alleviate the problems described above by detecting the approximate temperature around a discharge liquid and by changing a head drive voltage or waveform. However, an inkjet head would have to be provided with a complicated additional mechanism to solve the problem of the discharge liquid being heated by the operating heat. This is not a good solution, judging from the aspect of cost or reliability. Hence, there has been a demand for a solution that makes the most of the existing mechanism without adding a new mechanism.

SUMMARY OF THE INVENTION

The present invention has been made in view of the problems described above, and the objects of the invention are to:

(1) effectively cool a discharge liquid heated by the heat generated by a piezoelectric element, and (2) cool the discharge liquid, which has been heated by the heat generated by the piezoelectric element, while minimizing the need for an additional mechanism.

To fulfill the aforesaid objects, a first means related to a droplet discharging apparatus for discharging a discharge liquid in the form of droplets through an aperture by mechanically deforming a piezoelectric element by a normal drive signal adopts a construction in which the droplets are discharged through the aperture by a cooling drive signal, which is different from the normal drive signal.

Furthermore, a second means related to a droplet discharging apparatus adopts a construction in which the droplets are discharged for a plurality of times by the cooling drive signal so as to cool the discharge liquid to a specified temperature in the above first means.

A third means related to a droplet discharging apparatus adopts a construction in which the repetitive frequency of the cooling drive signal is set to a low frequency level that does not cause the piezoelectric element to heat the discharge liquid in the above first or second means.

A fourth means related to a droplet discharging apparatus adopts a construction in which the cooling drive signal is shape-set so as to cause droplets of a maximum weight to be discharged in any one of the above first to third means.

A fifth means related to a droplet discharging apparatus adopts a construction in which if the temperature of the discharge liquid detected by a temperature detecting means exceeds a predetermined threshold temperature, then the droplets are discharged from the aperture by the cooling drive signal in any one of the above first to fourth means.

A sixth means related to a droplet discharging apparatus adopts a construction in which if the number of discharges within a predetermined time performed in response to the normal drive signal exceeds a predetermined threshold number of times, then the droplets are discharged from the aperture by the cooling drive signal in any one of the above first to fourth means.

A seventh means related to a droplet discharging apparatus adopts a construction in which the cooling discharge by the cooling drive signal is carried out between normal discharges by the normal drive signal in any one of the above first to sixth means.

An eighth means related to a droplet discharging apparatus adopts a construction in which the discharge liquid is a printing ink in any one of the above first to seventh means.

A ninth means related to a droplet discharging apparatus adopts a construction in which the discharge liquid is an electrically conductive material for forming a wiring pattern in any one of the above first to seventh means.

A tenth means related to a droplet discharging apparatus adopts a construction in which the discharge liquid is a transparent resin for forming a microlens in any one of the above first to seventh means.

An eleventh means related to a droplet discharging apparatus adopts a construction in which the discharge liquid is a resin for forming a color layer of a color filter in any one of the above first to seventh means.

A twelfth means related to a droplet discharging apparatus adopts a construction in which the discharge liquid is an electro-optic material in any one of the first to seventh means.

A thirteenth means related to a droplet discharging apparatus adopts a construction in which the electro-optic material is a fluorescent organic compound presenting electroluminescence in the above twelfth means.

Furthermore, according to the present invention, a means related to a film manufacturing apparatus adopts a construction in which a film of a discharge liquid is formed by using the droplet discharging apparatus according to the above first to thirteenth means.

Additionally, according to the present invention, a means related to electronic equipment adopts a construction provided with a device manufactured using the film manufacturing apparatus according to the above means.

Furthermore, according to the present invention, as a first means related to a droplet discharging method, a method for discharging a discharge liquid in the form of droplets through an aperture by mechanically deforming a piezoelectric element adopts a construction in which the discharge liquid is cooled by cooling discharge, which is different from normal discharge.

As a second means related to the droplet discharging method, a construction is adopted in which the cooling discharge is carried out for a plurality of times so as to cool the discharge liquid to a specified temperature in the above first means.

As a third means related to a droplet discharging method, a construction is adopted in which the repetitive frequency of the cooling discharge is set to a low frequency level that does not cause the piezoelectric element to heat the discharge liquid in the above first or second means.

As a fourth means related to a droplet discharging method, a construction is adopted in which the cooling discharge causes droplets of a maximum weight to be discharged in any one of the above first to third means.

As a fifth means related to a droplet discharging method, a construction is adopted in which if the temperature of the discharge liquid exceeds a predetermined threshold temperature, then cooling discharge is carried out in any one of the above first to fourth means.

As a sixth means related to a droplet discharging method, a construction is adopted in which if the number of normal discharges within a predetermined time exceeds a predetermined threshold number of times, then the cooling discharge is carried out in any one of the above first to fourth means.

As a seventh means related to a droplet discharging method, a construction is adopted in which cooling discharge is carried out during the normal discharge in any one of the above first to sixth means.

As an eighth means related to a droplet discharging method, a construction is adopted in which the discharge liquid is a printing ink in any one of the above first to seventh means.

As a ninth means related to a droplet discharging method, a construction is adopted in which the discharge liquid is an electrically conductive material for forming a wiring pattern in any one of the above first to seventh means.

As a tenth means related to a droplet discharging method, a construction is adopted in which the discharge liquid is a transparent resin for forming a microlens in any one of the above first to seventh means.

As an eleventh means related to a droplet discharging method, a construction is adopted in which the discharge liquid is a resin for forming a color layer of a color filter in any one of the above first to seventh means.

As a twelfth means related to a droplet discharging method, a construction is adopted in which the discharge liquid is an electro-optic material in any one of the above first to seventh means.

As a thirteenth means related to a droplet discharging method, a construction is adopted in which the electro-optic material is a fluorescent organic compound exhibiting electroluminescence.

Furthermore, according to the present invention, as a means related to a film manufacturing method, a construction is adopted in which a film of a discharge liquid is formed by using the droplet discharging method according to any one of the above first to thirteenth means.

Furthermore, according to the present invention, as a means related to a device manufacturing method, a construction is adopted in which a device is manufactured by using the film manufacturing method according to the above means.

DESCRIPTION OF THE PREFERRED EMBODIMENTS

An embodiment of the droplet discharging apparatus and method, a film manufacturing apparatus and method, a device manufacturing method and electronic equipment in accordance with the present invention will be explained in conjunction with the accompanying drawings.

Construction of the Droplet Discharging Apparatus

Figure 1:
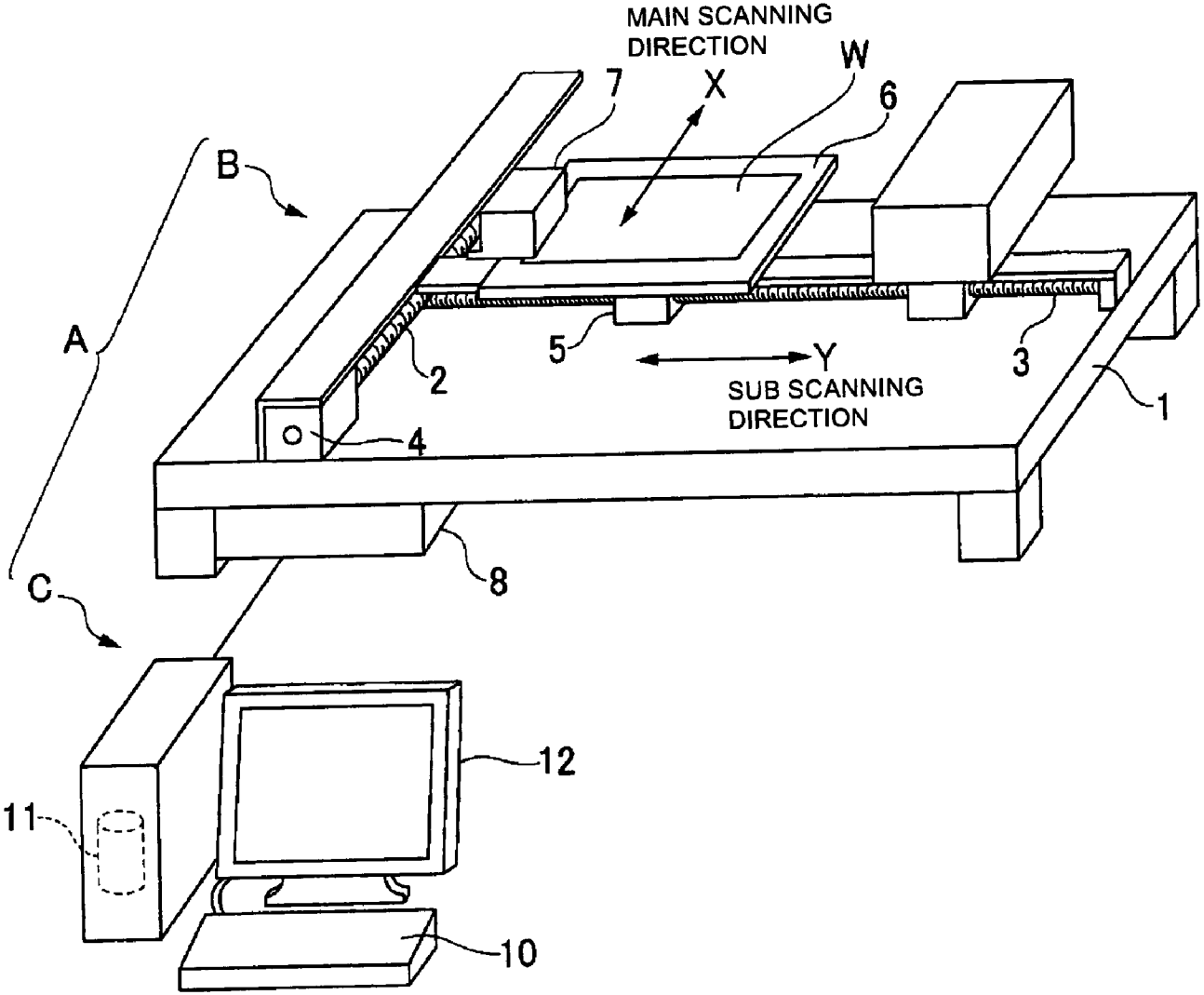
FIG. 1 is a perspective view showing the entire construction of a droplet discharging apparatus according to an embodiment of the present invention.

FIG. 1 is a perspective view showing the entire construction of a droplet discharging apparatus according to an embodiment. As shown in FIG. 1, a droplet discharging apparatus A is constructed of a main unit B and a control computer C. The main unit B is constructed primarily of a base 1, an X-direction drive shaft 2, a Y-direction drive shaft 3, an X-direction drive motor 4, a Y-direction drive motor 5, a stage 6, a discharging head 7, and a controller 8. The control computer C is provided primarily with a keyboard 10, an external memory 11, and a display 12.

The base 1 is a rectangular flat plate having a predetermined area, its front surface (upper surface) being provided with the X-direction drive shaft 2 and the Y-direction drive shaft 3 disposed to be orthogonal to each other. The X-direction drive shaft 2 is constructed of a ball screw or the like and rotatively driven by the X-direction drive motor 4. The X-direction drive motor 4 is, for example, a stepping motor, and revolves the X-direction drive shaft 2 on the basis of the drive signals received from the controller 8 so as to move the discharging head 7 in the X-direction (main scanning direction) on the base 1.

The Y-direction drive shaft 3 is composed of a ball screw, as in the case of the X-direction drive shaft 2, and is rotatively driven by the Y-direction drive motor 5. The Y-direction drive motor 5 is, for example, a stepping motor, and revolves the Y-direction drive shaft 3 on the basis of the drive signals received from the controller 8 so as to move the stage 6 in the Y-direction (sub scanning direction) on the base 1. The stage 6 is a rectangular flat plate on which an object W is fixedly rested on the upper surface thereof. The object W is the target to which the droplets discharged from the discharging head 7 are applied. The object W may be various types of paper, substrates, etc.

The discharging head 7 is adapted to discharge a discharge liquid, which is held therein, in the form of droplets by utilizing the mechanical deformation of a piezoelectric element. The detailed construction of the discharging head 7 will be described hereinafter. A variety of types of discharge liquid is used according to the applications of the droplet discharging apparatus A. The discharge liquids may be, for example, diverse types of ink or resin, or electro-optical materials. The controller 8 controls and drives the X-direction drive motor 4, the Y-direction drive motor 5 and the discharging head 7 under the control of the control computer C.

The keyboard 10, which is an element of the control computer C, is used to enter the information regarding diverse types of setting, including discharging conditions for discharging droplets toward the object W. The external memory 11 is, for example, a hard disk device, and stores the information regarding diverse types of setting input through the keyboard 10. The display 12 is for displaying on its screen the information regarding various types of setting already stored in the external memory 11 or the information regarding various types of setting entered through the keyboard 10.

The droplet discharging apparatus A constructed as described above operates the X-direction drive motor 4 and the Y-direction drive motor 5 under the control of the control computer C so as to arbitrarily set the relative positional relationship between the object W and the discharging head 7 and to discharge droplets from the discharging head 7 toward an arbitrary position on the object W to adhere the droplets thereto.

Detailed Construction of the Discharging Head 7

Figure 2:
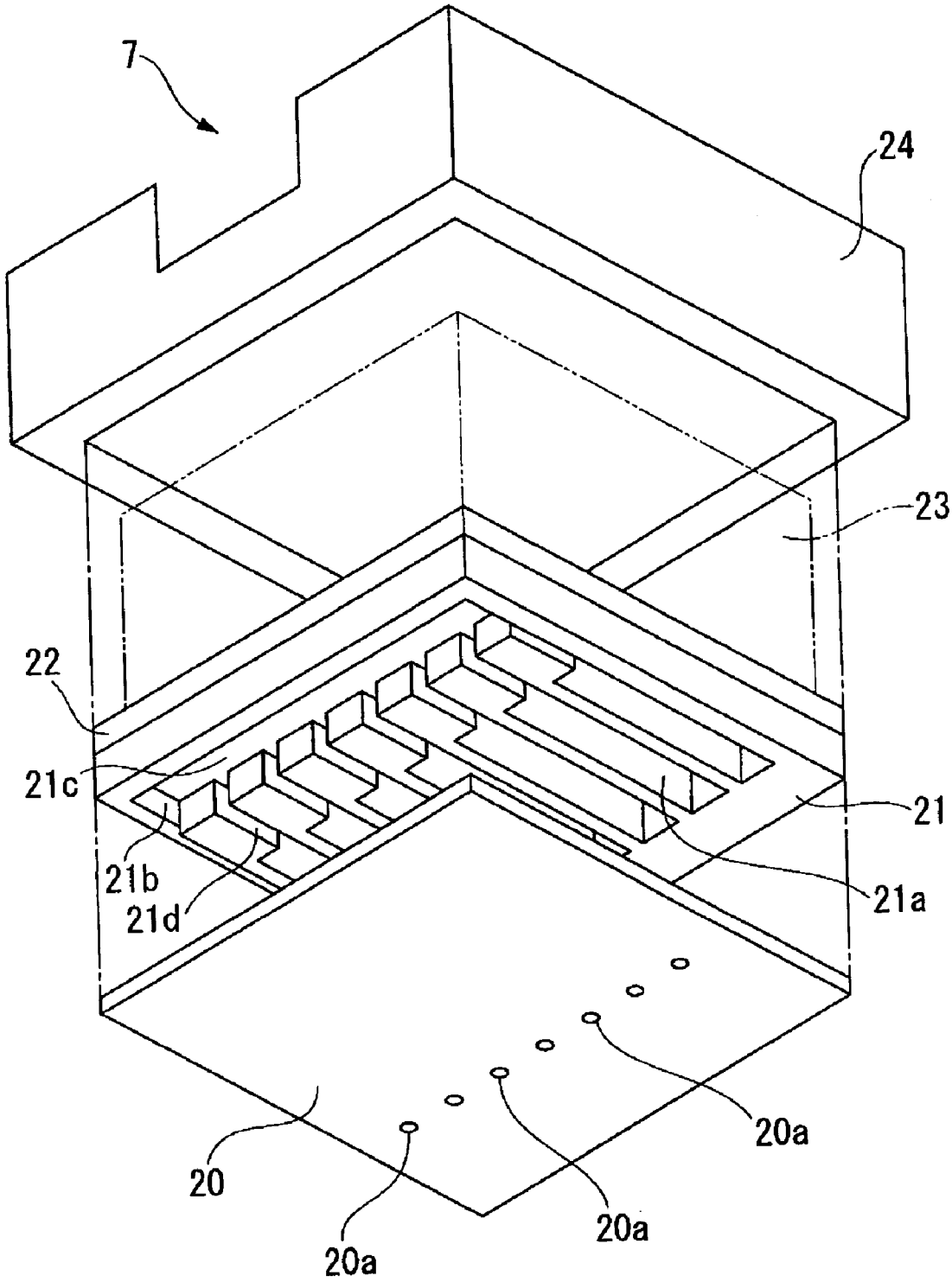
FIG. 2 is an exploded perspective view showing the detailed construction of a discharging head 7 in the embodiment of the present invention.

FIG. 2 is an exploded perspective view showing the detailed construction of the discharging head 7. The discharging head 7 is composed primarily of a nozzle plate 20, a pressure generating chamber plate 21, a diaphragm 22, an actuator 23 and a casing 24.

The nozzle plate 20 is a flat plate, in which a plurality of discharging apertures 20*a* is formed at predetermined intervals, and has pressure generating chambers 21*a*, side walls (partition walls) 21*b*, a reservoir 21*c* and a lead-in passages 21*d*, which are formed by etching. The plural pressure generating chambers 21*a* are provided in association with the discharging apertures 20*a*, and serve as the spaces for storing a discharge liquid immediately before discharging. The side walls 21*b* partition the pressure generating chambers 21*a*. The reservoir 21*c* is a flow channel for supplying a discharge liquid to the pressure generating chambers 21*a*. The lead-in passages 21*d* lead the discharge liquid from the reservoir 21*c* to the individual pressure generating chambers 21*a*.

The diaphragm 22 is an elastic deformable sheet and bonded to the upper surface of the pressure generating chamber plate 21. More specifically, the nozzle plate 20, the pressure generating chamber plate 21 and the diaphragm 22 make up a three-layer structure, the layers being bonded with an adhesive agent. The upper surface of the diaphragm 22 is provided with an actuator 23. The portions of the diaphragm 22 that are associated with the individual pressure generating chambers 21*a* are deformed perpendicular to the surface by the piezoelectric element in the actuator 23. The nozzle plate 20, the pressure generating chamber plate 21, the diaphragm 22 and the actuator 23 are housed together in the casing 24 to form the integral discharging head 7.

Detailed Construction of the Actuator 23

Figure 3:
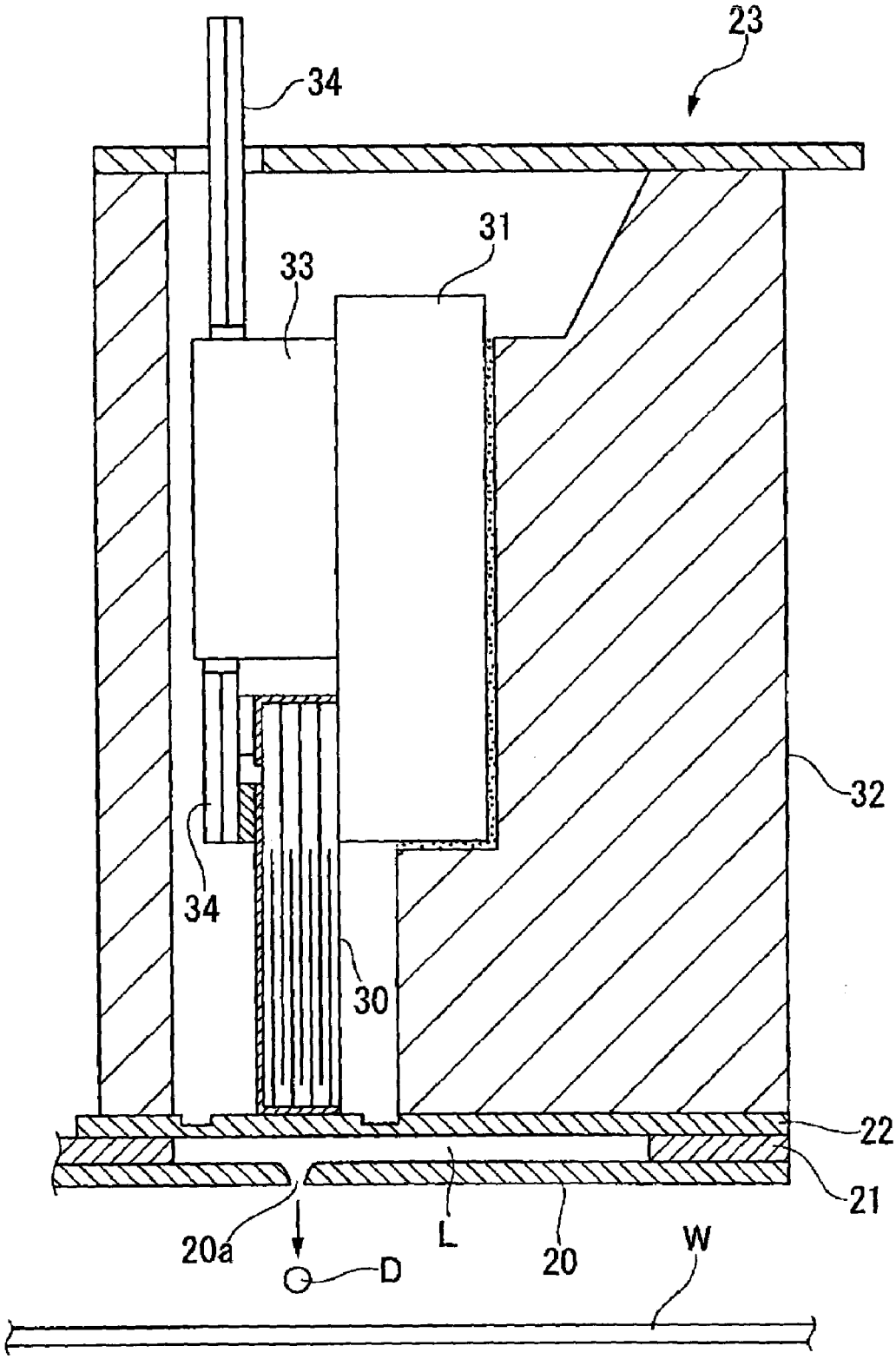
FIG. 3 is a longitudinal sectional view showing the detailed construction of an actuator 23 in the embodiment of the present invention.

FIG. 3 is a longitudinal sectional view showing the detailed construction of the actuator 23. As shown in the figure, one end of a piezoelectric element 30 is adhesively secured to the portions of the diaphragm 22 that are associated with the individual pressure generating chambers 21*a*. The piezoelectric element 30 vertically expands and contracts when subjected to a voltage applied from outside. The other end of the piezoelectric element 30 is adhesively bonded to a fixed substrate 31. The fixed substrate 31 is adhesively secured to a holder 32. The holder 32 is secured on the diaphragm 22.

A drive integrated circuit 33 is adhesively secured on the fixed substrate 31. Various control signals and drive signals (normal drive signal and cooling drive signal) are supplied from the controller 8 (refer to FIG. 1) to the drive integrated circuit 33 through a flexible cable 34. The drive integrated circuit 33 selectively outputs various drive signals on the basis of the aforesaid control signals. Various drive signals selected by the drive integrated circuit 33 are supplied to each piezoelectric element 30 through the flexible cable 34.

More specifically, in the discharging head 7 of the droplet discharging apparatus A, the piezoelectric elements 30 vertically expand and contract in response to various drive signals selectively supplied from the drive integrated circuit 33 to the piezoelectric elements 30. The expansion and contraction of the piezoelectric elements 30 cause the portion of the diaphragm 22 that is positioned right under the piezoelectric elements 30 to deform in the vertical direction, that is, in the direction perpendicular to the surface of the diaphragm 22. This causes a discharge liquid L held in the pressure generating chambers 21*a* to be discharged in the form of droplets D toward the object W.

Electric Functional Construction

Figure 4:
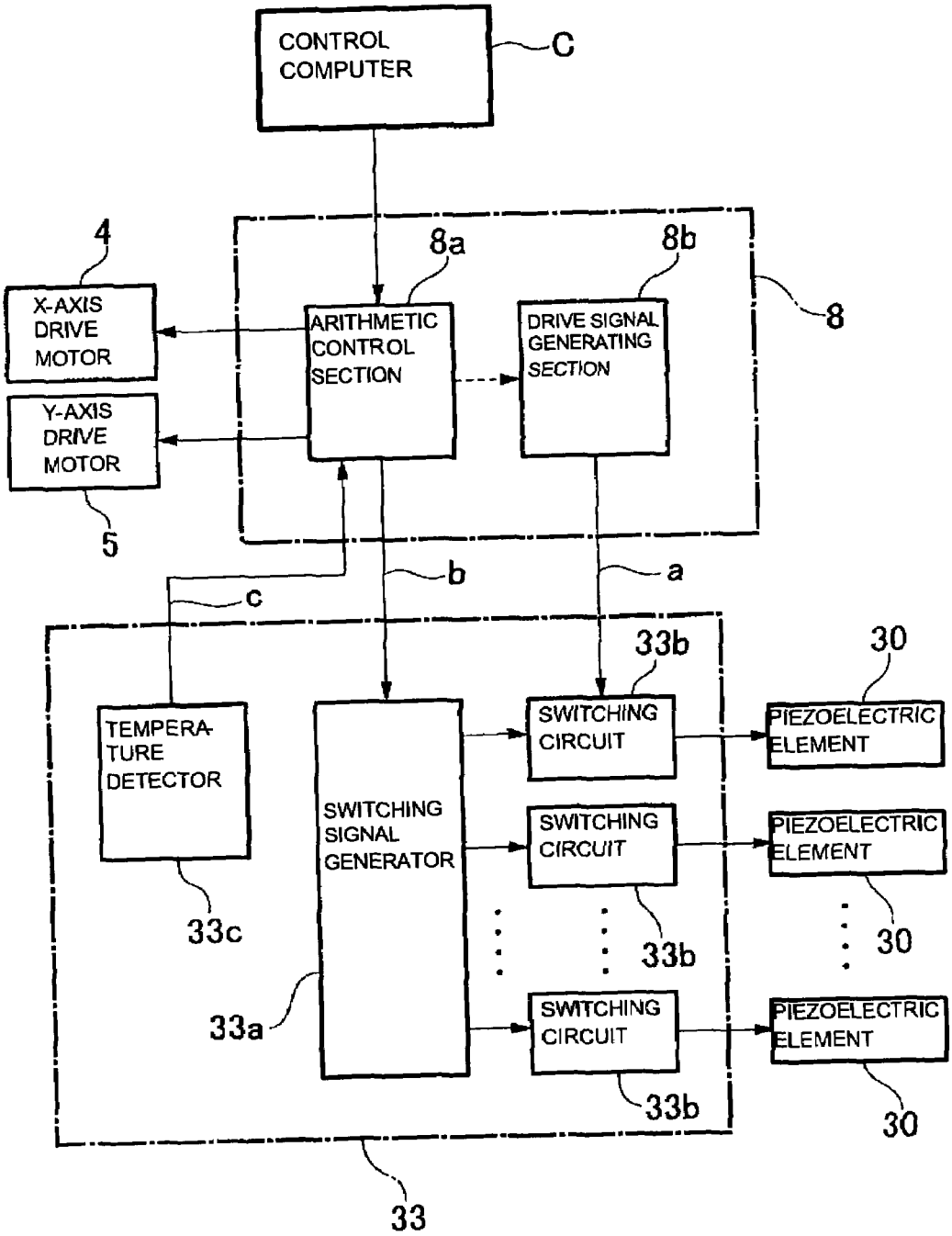
FIG. 4 is a block diagram showing the electric functional construction of the droplet discharging apparatus according to the embodiment of the present invention.

Referring now to FIG. 4, the electric functional construction of the droplet discharging apparatus A will be explained. As shown in FIG. 4, the controller 8 provided in the main unit B is constructed of an arithmetic control section 8*a* and a drive signal generating section 8*b*. The drive integrated circuit 33 provided in the discharging head 7 is composed mainly of a switching signal generator 33*a*, a switching circuit 33*b* and a temperature detector 33*c*.

The arithmetic control section 8*a* controls and drives the X-direction drive motor 4 and the Y-direction drive motor 5 according to the setting information received from the control computer C and control programs stored therein beforehand, and also outputs various types of data for generating various drive signals a for driving the piezoelectric elements 30 (data for generating drive signals) to the drive signal generating section 8*b*. Furthermore, the arithmetic control section 8*a* generates selection data b according to the control programs and outputs the generated selection data b to the switching signal generator 33*a*. The selection data b is formed of nozzle selection data for designating the piezoelectric element 30 to which the drive signal a is applied and waveform selection data for designating the drive signal to be applied to the piezoelectric element 30.

The arithmetic control section 8*a* is configured so as to generate the aforementioned waveform selection data, taking a temperature detection signal c received from the temperature detector 33*c* also into account. More specifically, the arithmetic control section 8*a* instructs the switching signal generator 33*a* to select either the normal drive signal or the cooling drive signal on the basis of the temperature detection signal c.

The drive signal generating section 8*b* generates various drive signals of predetermined shapes, namely, the normal drive signal and the cooling drive signal, based on the aforesaid data for generating drive signals, then outputs the generated signals to the switching circuit 33*b*.

Figure 5A:
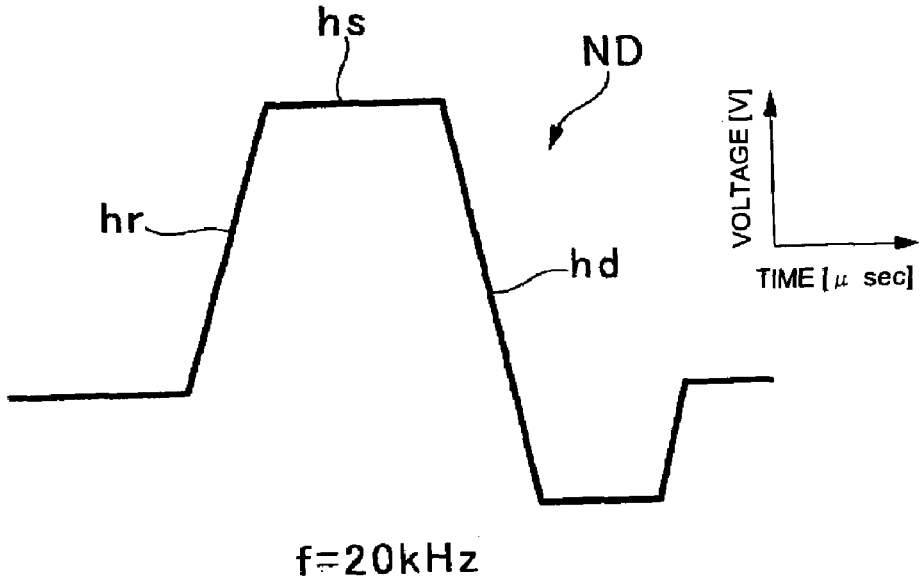
FIG. 5 is a schematic diagram showing the waveforms (for 1 cycle) of a normal drive signal and a cooling drive signal in the embodiment of the present invention.
Figure 5B:
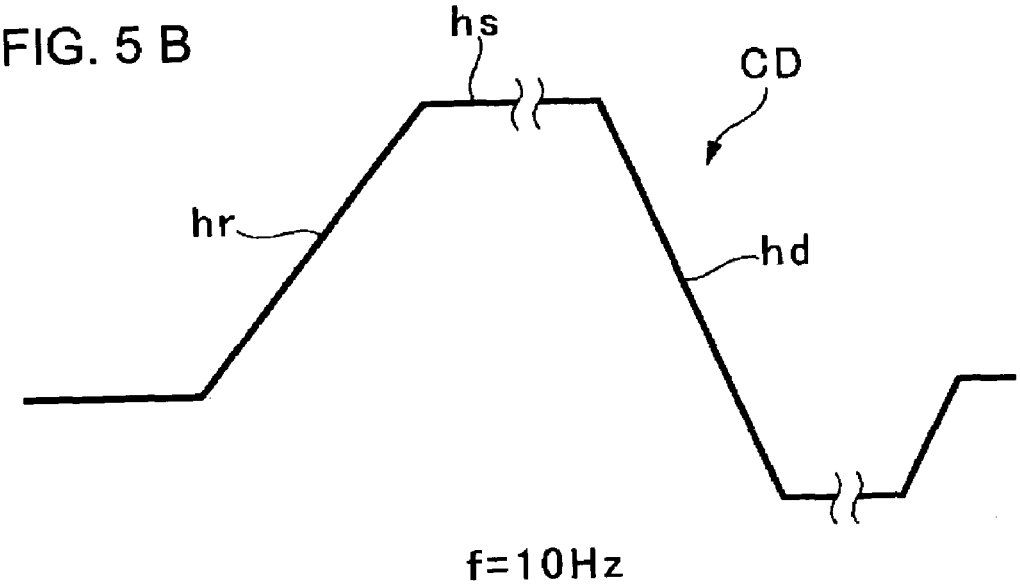

FIG. 5 is a schematic diagram showing the waveforms (1 cycle) of the normal drive signal and the cooling drive signal. In FIG. 5, (*a*) shows the waveform of a normal drive signal ND, while (b) shows the waveform of a cooling drive signal CD. A repetitive frequency f of the normal drive signal ND is set at 20 kHz, while the repetitive frequency f of the cooling drive signal CD is set at, for example, 10 Hz. The repetitive frequency f in the vicinity of 10 Hz makes it possible to adequately drive the piezoelectric elements 30, while minimizing the heat (operating heat) generated by the operation of the piezoelectric elements 30 (that is, a frequency level that does not cause the discharge liquid L to be heated) at the same time.

A rising slope hr, a horizontal holding time hs and a falling slope hd of the normal drive signal ND and the cooling drive signal CD define the size, i.e., the weight, of a droplet D. The rising slope hr and the falling slope hd of the cooling drive signal CD are set to be more gentle than the rising slope hr and the falling slope hd of the normal drive signal ND. The holding time hs of the cooling drive signal CD is set to be longer than the holding time of the normal drive signal ND. This arrangement makes it possible to set the rising slope hr, the holding time hs and the falling slope hd of the cooling drive signal CD so as to obtain, for example, the size of the droplet that provides a maximum weight. The maximum weight in this case indicates the volume that is half the volume of the pressure generating chamber 21*a* shown in FIG. 2.

In theory, it is impossible to discharge ink exceeding the half of the volume of the pressure chamber, because at least half the volume in the pressure generating chamber 21*a* is undesirably released to the reservoir 21*c* through the lead-in channel 21*d*. Accordingly, the cooling drive signal CD is shape-set to cause the largest possible droplet D to be discharged through the discharging aperture 20*a* for each discharging operation.

The switching signal generator 33*a* generates switching signals indicating ON/OFF of the drive signal a to be supplied to the piezoelectric elements 30 on the basis of the selection data b and outputs the generated switching signals to the switching circuit 33*b*. The switching circuit 33*b* is provided for each piezoelectric element 30 and outputs the drive signal designated by a switching signal to the piezoelectric element 30. The temperature detector 33*c* detects the operating temperature of the drive integrated circuit 33 and outputs the detected temperature as the temperature detection signal c to the arithmetic control section 8*a*.

As shown in FIG. 3, the drive integrated circuit 33 is adhesively secured to the fixed substrate 31, and the other end of each of the piezoelectric elements 30, which generate heat (operating heat) by the actuation based on the drive signals, is adhesively secured to the fixed substrate 31. This means that the drive integrated circuit 33, which includes the temperature detector 33*c*, and the piezoelectric elements 30 are closely thermally coupled through the intermediary of the fixed substrate 31 featuring good thermal conductivity. Hence, the operating temperature of the drive integrated circuit 33 detected by the temperature detector 33*c* accurately reflects the operating heat of the piezoelectric elements 30. Furthermore, the piezoelectric elements 30 are in close thermal connection with the discharge liquid L through the intermediary of the diaphragm 22 (sheet), so that the temperature detector 33*c* substantially accurately detects the temperature of the discharge liquid L as the temperature of the piezoelectric elements 30 although there is some temperature difference.

The operation of the droplet discharging apparatus constructed as described above will be explained in detail by referring also to FIG. 6.

First, the normal operation will be explained.

The control and drive of the X-direction drive motor 4 and the Y-direction drive motor 5 by the arithmetic control section 8*a* and the output of the selection data b supplied to the switching signal generator 33*a*, and the output of various drive signals issued by the drive signal generating section 8*b* to the switching circuit 33*b* are performed in synchronization. More specifically, in a state wherein the X-direction drive motor 4 and the Y-direction drive motor 5 have been actuated under the control and drive by the arithmetic control section 8*a* to set appropriate relative positions of the discharging head 7 and the object W, the normal drive signal ND is continuously applied to the piezoelectric elements 30 from the switching circuit 33*b* of the drive integrated circuit 33, causing the discharge liquid L to be continuously discharged (normal discharge) as the droplets D from the discharging apertures 20*a* toward the object W.

The normal discharge is carried out at a relatively high repetitive frequency f, 20 kHz, thus causing the piezoelectric elements 30 and the drive integrated circuit 33 to generate much operating heat. This causes the discharge liquid L to be heated with a resultant temperature rise by the operating heat of the piezoelectric elements 30 and the drive integrated circuit 33. The rise in the temperature of the discharge liquid L is equivalently detected as the rise in the temperature of the piezoelectric elements 30 by the temperature detector 33*c* in the drive integrated circuit 33 in tight thermal connection with the piezoelectric elements 30 through the intermediary of the fixed substrate 31.

The arithmetic control section 8*a* monitors the temperature of the discharge liquid L on the basis of the temperature detection signal c received from the temperature detector 33*c*. If the temperature exceeds a predetermined threshold temperature, then the arithmetic control section 8*a* instructs the drive signal generating section 8*b* to generate the cooling drive signal CD, generates the selection data b calling for the application of the cooling drive signal CD to the piezoelectric elements 30, and outputs the generated selection data b to the switching signal generator 33*a*. As a result, the cooling drive signal CD is applied to the piezoelectric elements 30, and the droplets D of the maximum weight are discharged from the discharging apertures 20*a* at the 10-Hz repetitive frequency f (cooling discharge). This causes some of the operating heat of the piezoelectric elements 30 to be released outside by the droplets D and some of the operating heat of the drive integrated circuit 33 to be released outside by the droplets D through the intermediary of the fixed substrate 31. At the same time, less heated liquid in the reservoir 21 passes through the lead-in channel 21*d* and gradually flows into the pressure generating chamber 21*a* so as to gradually cool the temperature of the discharge liquid L.

Figure 6:
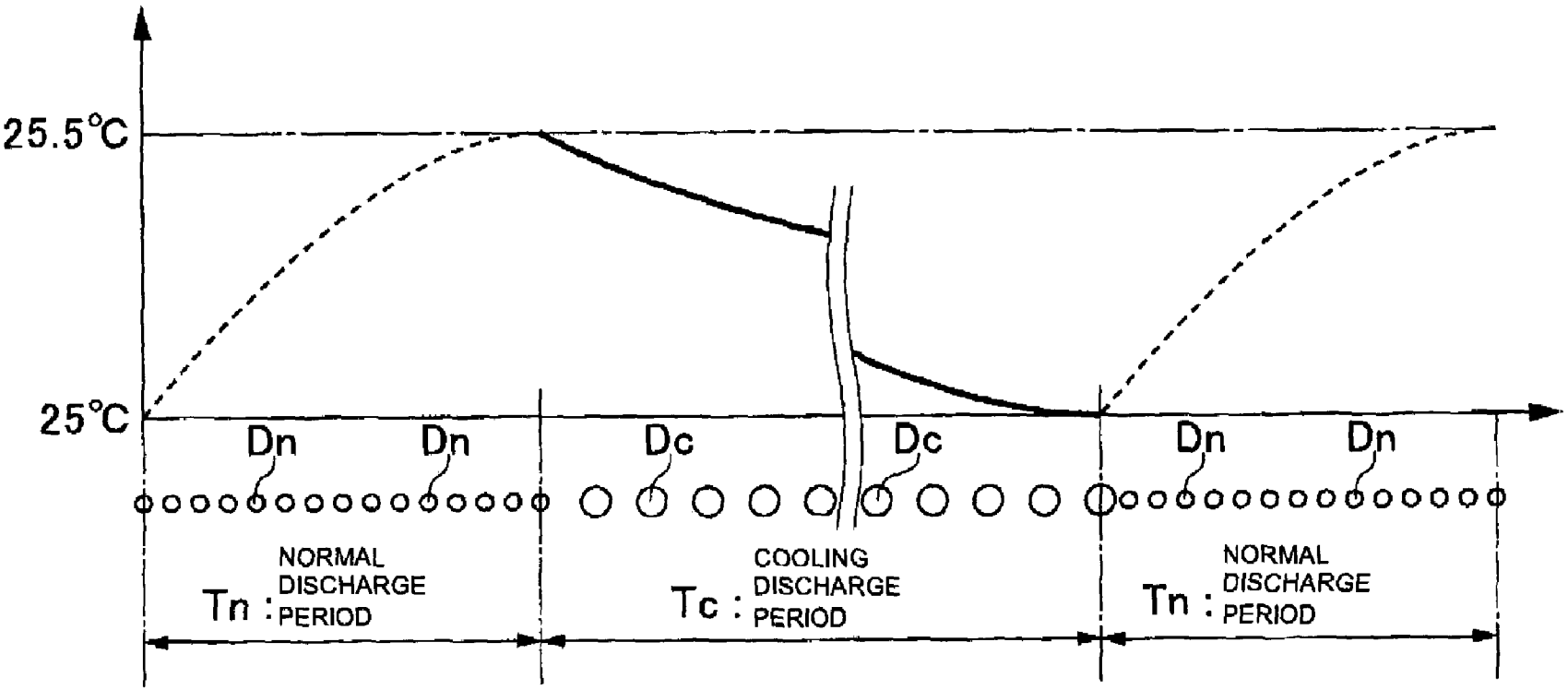
FIG. 6 is a schematic diagram showing an example of a temperature change in a discharge liquid L in the embodiment of the present invention.

FIG. 6 is a schematic diagram showing an example of the temperature change in the discharge liquid L. In a normal discharge period Tn, droplets (normal droplets Dn) of a normal size (normal weight) based on the waveform of the normal drive signal ND are continuously discharged at the repetitive frequency of 20 kHz from the discharging apertures 20*a*. In a cooling discharge period Tc, the droplets (largest droplets Dc) of the maximum size (maximum weight) are continuously discharged from the discharging apertures 20*a* toward the object W at the repetitive frequency of 10 Hz by the cooling drive signal CD. In the normal discharge period Tn, the temperature of the discharge liquid L gradually rises from its predetermined temperature, 25° C. When the above threshold temperature, 25.5° C., is exceeded, the normal discharge period Tn is replaced by the cooling discharge period Tc wherein the temperature gradually drops. Then, when the temperature of the discharge liquid L restores the predetermined level, the operation is switched to the normal discharge period Tn again in which the temperature starts to rise.

In the droplet discharging apparatus according to the embodiment, between the cycles in which normal discharge is carried out on the object W, that is, in the stage before the discharge for the following line is performed after the completion of the discharge for one line in the X-direction, a preliminary discharging process (flushing process) is implemented to secure proper discharging performance for the following line. The aforesaid cooling discharge period Tc corresponds to the flushing process. In other words, the droplet discharging apparatus carries out the cooling discharge in the flushing process preceding the normal discharge so as to set the temperature of the discharge liquid L back to the predetermined temperature.

According to the embodiment, when the temperature of the discharge liquid L exceeds a threshold temperature during normal discharge, the cooling discharge is carried out to discharge largest droplets Dc at a significantly lower repetitive frequency (f=10 Hz) than that for the normal discharge. This makes it possible to maintain or set the temperature of the discharge liquid L in the normal discharge within a predetermined appropriate temperature range. In addition, carrying out the cooling discharge during the flushing process allows the discharge liquid L to be cooled without sacrificing the operating efficiency of the droplet discharging apparatus.

The droplet discharging apparatus can be used for extensive applications, including the following applications:

(1) A printing apparatus for drawing characters and pictures by discharging ink as the discharge liquid L toward paper or various types of film as the object W.

(2) A pattern drawing apparatus for drawing wiring patterns for electronic circuits by discharging an electrically conductive liquid as the discharge liquid L toward a substrate as the object W.

(3) A microlens manufacturing apparatus for producing microlenses by discharging a transparent resin as the discharge liquid L onto a substrate as the object W. In this case, the transparent resin adhering to the substrate is solidified by applying ultraviolet rays or the like to eventually form a microlens on the substrate.

(4) A color filter manufacturing apparatus for producing color layers for color filters by discharging a coloring resin as the discharge liquid L onto a substrate as the object W.

(5) An organic EL display panel manufacturing apparatus for producing organic electroluminescence (EL) display panels by discharging an electro-optical material, namely, a fluorescent organic chemical compound exhibiting electroluminescence, as the discharge liquid L to a substrate as the object W.

(6) Furthermore, the droplet discharging apparatus and method according to the embodiment can be applied to a film manufacturing apparatus and method for forming films of a discharge liquid, or a device manufacturing method for manufacturing devices by using the film manufacturing apparatus and method, or to electronic equipment incorporating the devices.

In the embodiment described above, the temperature detector 33*c* is provided and the cooling discharge is carried out on the basis of the temperature detection signal c input from the temperature detector 33*c*. Alternatively, however, the temperature detector 33*c* may not be provided, and the cooling discharge may be carried out when the number of normal discharges exceeds a predetermined threshold number. More specifically, the arithmetic control section 8*a* is configured such that the number of normal discharges is counted, and when the count result exceeds the threshold number, the cooling discharge is carried out.

In the embodiment described above, the cooling discharge is carried out when the temperature of the discharge liquid L exceeds the threshold temperature during the normal discharge. The cooling discharge, however, is not always necessary if there is a time allowance before the next normal discharge begins. More specifically, if it is possible to cool the discharge liquid L to a predetermined temperature by natural cooling, then the discharge liquid L is let cool naturally, omitting the cooling discharge. The cooling discharge may be performed only if the discharge liquid L cannot be cooled to the predetermined temperature by natural cooling.

As explained in detail above, according to the present invention, to discharge a discharge liquid from apertures in the form of droplets by mechanically deforming the piezoelectric elements by the normal drive signal, the droplets are discharged from the apertures by the cooling drive signal, which is different from the normal drive signal. This means that the droplets deprive the discharge liquid of its heat, thus making it possible to effectively to cool the discharge liquid that has been heated by the heat generated by the piezoelectric elements.

This application claims priority to and hereby incorporates by reference Japanese patent application No. 2002-319773 filed Nov. 1, 2002.

What is claimed is:

1. A droplet discharging apparatus comprising:

means for discharging a discharge liquid in the form of droplets through an aperture by mechanically deforming a piezoelectric element by a normal drive signal;

a drive integrated circuit disposed adjacent to and in thermal contact with the piezoelectric element;

a control unit that generates the normal drive signal and a cooling drive signal and supplies one of the normal drive signal and the cooling drive signal to the drive integrated circuit, wherein the normal drive signal includes a waveform having a different frequency, a steeper rising slope, a steeper falling slope, and a shorter holding time than the cooling drive signal;

a substrate attached to and in thermal contact with the piezoelectric element and the drive integrated circuit;

a diaphragm disposed adjacent to and in thermal contact with the piezoelectric element; and a temperature sensor associated with the drive integrated circuit for sensing a temperature of the drive integrated circuit;

wherein the sensed temperature of the drive integrated circuit reflects an operating heat of the piezoelectric element due to the piezoelectric element being thermally coupled to the drive integrated circuit via the substrate;

wherein the sensed temperature of the drive integrated circuit reflects the temperature of the discharge liquid due to the thermal connection of the discharge liquid, the diaphragm, the piezoelectric element, the substrate, and the drive integrated circuit;

wherein the control unit selects between the normal drive signal and the cooling drive signal based on the temperature of the discharge liquid;

wherein the droplets are discharged from the aperture based on the selected normal drive signal or cooling drive signal; and wherein a flushing process is implemented between cycles of normal discharge to set the temperature of the discharge liquid to a predetermined temperature, the flushing process including selecting the cooling drive signal following periods of normal discharge to set the temperature of the discharge liquid to a predetermined temperature prior to initiating a subsequent normal discharge.

2. The droplet discharging apparatus according to claim 1, wherein the droplets are discharged for a plurality of times by the cooling drive signal so as to cool the discharge liquid to the predetermined temperature.

3. The droplet discharging apparatus according to claim 1, wherein the cooling drive signal is set to a low frequency level that does not cause the piezoelectric element to heat the discharge liquid.

4. The droplet discharging apparatus according claim 1, wherein the cooling drive signal has a waveform shape set so as to cause droplets of a maximum weight to be discharged.

5. The droplet discharging apparatus according to claim 1, wherein if the temperature of the discharge liquid detected by a temperature detecting means exceeds a predetermined threshold temperature, then the droplets are discharged from the aperture by the cooling drive signal.

6. The droplet discharging apparatus according to claim 1, wherein if the number of discharges within a predetermined time performed in response to the normal drive signal exceeds a predetermined threshold number of times, then the droplets are discharged from the aperture by the cooling drive signal.

7. The droplet discharging apparatus according to claim 1, wherein the discharge liquid is a printing ink.

8. The droplet discharging apparatus according to claim 1, wherein the discharge liquid is an electrically conductive material for forming a wiring pattern.

9. The droplet discharging apparatus according to claim 1, wherein the discharge liquid is a transparent resin for forming a microlens.

10. The droplet discharging apparatus according to claim 1, wherein the discharge liquid is a resin for forming a color layer of a color filter.

11. The droplet discharging apparatus according to claim 1, wherein the discharge liquid is an electro-optic material.

12. The droplet discharging apparatus according to claim 11, wherein the electro-optic material is a fluorescent organic compound exhibiting electroluminescence.

13. The droplet discharging apparatus according to claim 1, wherein the diaphragm separates the piezoelectric element from the discharge liquid.

14. The droplet discharging apparatus according to claim 1, wherein the piezoelectric element and drive integrated circuit are attached to the substrate by an adhesive.

15. The droplet discharging apparatus according to claim 1, wherein the piezoelectric element and drive integrated circuit are attached to the substrate and are spaced apart from one another.

16. The droplet discharging apparatus according to claim 1, wherein the normal drive signal includes a frequency of approximately 20 kHz and the cooling drive signal includes a frequency of approximately 10 Hz.

17. The droplet discharging apparatus according to claim 1, further comprising a switching signal generator that selects between the normal drive signal and the cooling drive signal.

18. The droplet discharging apparatus of claim 1, wherein the normal drive signal is separate and distinct from the cooling drive signal.

19. A droplet discharging method comprising:

sensing a temperature of a drive integrated circuit disposed adjacent to and in thermal contact with a piezoelectric element;

determining a temperature of a discharge liquid disposed adjacent to the piezoelectric element based on the detected temperature of the drive integrated circuit;

selecting between a normal drive signal and a cooling drive signal based on the temperature of the discharge liquid;

discharging the discharge liquid in the form of droplets through an aperture by mechanically deforming the piezoelectric element based on the selected normal drive signal or cooling drive signal;

selecting the cooling drive signal during a flushing process following periods of normal discharge of the discharge liquid;

discharging the discharge liquid by mechanically deforming the piezoelectric element based on the cooling drive signal during the flushing process to cool the discharge liquid prior to a subsequent normal discharge; and selecting the normal drive signal following the flushing process;

wherein selecting the normal drive signal includes generating a waveform having a different frequency, a steeper rising slope, a steeper falling slope, and a shorter holding time than the cooling drive signal.

20. The droplet discharging method according to claim 19, wherein the cooling drive signal is applied a predetermined number of times so as to cool the discharge liquid to a specified temperature.

21. The droplet discharging method according to claim 19, wherein the cooling drive signal is set to a low frequency level that does not cause the piezoelectric element to heat the discharge liquid.

22. The droplet discharging method according to claim 19, wherein the cooling drive signal causes droplets of a maximum weight to be discharged.

23. The droplet discharging method according to claim 19, wherein if the temperature of the discharge liquid exceeds a predetermined threshold temperature, the cooling drive signal is selected.

24. The droplet discharging method according to claim 19, wherein if the number of normal discharges within a predetermined time exceeds a predetermined threshold number of times, the cooling drive signal is selected.

25. The droplet discharging method according to claim 19, wherein cooling discharge is carried out during the normal discharge.

26. The droplet discharging method according to claim 19, wherein the discharge liquid is a printing ink.

27. The droplet discharging method according to claim 19, wherein the discharge liquid is an electrically conductive material for forming a wiring pattern.

28. The droplet discharging method according to claim 19, wherein the discharge liquid is a transparent resin for forming a microlens.

29. The droplet discharging method according to claim 19, wherein the discharge liquid is a resin for forming a color layer of a color filter.

30. The droplet discharging method according to claim 19, wherein the discharge liquid is an electro-optic material.

31. The droplet discharging method according to claim 30, wherein the electro-optic material is a fluorescent organic compound exhibiting electroluminescence.

32. The droplet discharging method according to claim 19, wherein selecting the normal drive signal includes generating a waveform having a frequency of approximately 20 kHz and wherein selecting the cooling drive signal includes generating a waveform having a frequency of approximately 10 Hz.

33. The droplet discharging method according to claim 19, wherein selecting between the normal drive signal and the cooling drive signal includes selecting between two separate and distinct signals.

* * * * *